US010501917B2

(12) United States Patent
Ali et al.

(10) Patent No.: US 10,501,917 B2
(45) **Date of Patent: *Dec. 10, 2019**

(54) DRAIN STRAINER

(71) Applicant: Naushad Ali, Redmond, WA (US)

(72) Inventors: Naushad Ali, Redmond, WA (US); David B. Nebel, Chicago, IL (US); Bridget M. Soldan, Lisle, IL (US); Joseph Z. Wascow, Vernon Hills, IL (US)

(73) Assignee: Naushad Ali, Redmond, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/920,235

(22) Filed: Mar. 13, 2018

(65) Prior Publication Data

US 2019/0017255 A1 Jan. 17, 2019

Related U.S. Application Data

(63) Continuation of application No. 15/162,408, filed on May 23, 2016, now Pat. No. 9,945,106, which is a continuation of application No. 14/060,477, filed on Oct. 22, 2013, now Pat. No. 9,371,636, which is a continuation of application No. 13/686,724, filed on Nov. 27, 2012, now Pat. No. 8,590,065.

(60) Provisional application No. 61/590,263, filed on Jan. 24, 2012, provisional application No. 61/680,204, filed on Aug. 6, 2012.

(51) Int. Cl.

| | |
|---|---|
| ***E03C 1/262*** | (2006.01) |
| ***A47K 1/14*** | (2006.01) |
| ***E03C 1/23*** | (2006.01) |

(52) U.S. Cl.
CPC ..... *E03C 1/262* (2013.01); *A47K 1/14* (2013.01); *E03C 1/2302* (2013.01)

(58) Field of Classification Search
CPC ..... E03C 1/262
USPC ..... 4/286–295
See application file for complete search history.

(56) References Cited

U.S. PATENT DOCUMENTS

| | | | |
|---|---|---|---|
| 769,001 | A | 8/1904 | Lawrence |
| 1,756,290 | A | 4/1930 | Hibner |
| 1,770,639 | A | 7/1930 | West et al. |
| 2,285,833 | A | 6/1942 | Platt |
| 2,331,055 | A | 10/1943 | Smith |

(Continued)

FOREIGN PATENT DOCUMENTS

| | | | |
|---|---|---|---|
| CN | 201762779 | U | 3/2011 |
| JP | 2008-25276 | A | 2/2008 |

(Continued)

OTHER PUBLICATIONS

International Search Report and Written Opinion, dated May 15, 2013, for International Application No. PCT/US2013/022289, 10 pages.

*Primary Examiner* — Lori L Baker
(74) *Attorney, Agent, or Firm* — Seed IP Law Group LLP

(57) ABSTRACT

A stopper assembly for a drain system of a fluid basin and related methods, systems and components. The stopper head assembly includes a stopper head having a seal to sealingly engage the drain system of the fluid basin when the stopper assembly is moved from a drain position to a plug position and a strainer to strain fluid passing through the drain system when the stopper head is in a drain position.

20 Claims, 10 Drawing Sheets

(56) References Cited

U.S. PATENT DOCUMENTS

| | | | | |
|---|---|---|---|---|
| 2,337,331 | A | 12/1943 | Kirschner | |
| 2,698,441 | A | 1/1955 | Shobe | |
| 3,333,815 | A | 8/1967 | Downey et al. | |
| 3,588,928 | A | 6/1971 | Hiertz | |
| 3,596,294 | A | 8/1971 | Hoffman | |
| 3,800,339 | A | 4/1974 | Bergin | |
| 3,802,001 | A | 4/1974 | Richards | |
| 3,813,708 | A | 6/1974 | Hamburg | |
| 3,911,508 | A | 10/1975 | Goldberg | |
| 4,045,351 | A | 8/1977 | Peterson | |
| 4,207,631 | A | 6/1980 | Baggey | |
| 4,276,662 | A | 7/1981 | Young | |
| 4,369,531 | A | 1/1983 | Swanson | |
| 4,380,834 | A | 4/1983 | Wentz | |
| 4,571,751 | A | 2/1986 | Barlow | |
| 4,597,112 | A | 7/1986 | Cuschera | |
| 4,720,877 | A | 1/1988 | Watts | |
| 4,860,390 | A | 8/1989 | Ohta | |
| 4,932,082 | A | 6/1990 | Ridgeway | |
| 5,072,461 | A | 12/1991 | Logsdon | |
| 5,165,118 | A | 11/1992 | Cendrowski | |
| 5,369,815 | A | 12/1994 | Martin | |
| D357,306 | S | 4/1995 | Lenox | |
| 5,724,684 | A | 3/1998 | Paar | |
| 5,915,847 | A | 6/1999 | Spears | |
| 6,058,526 | A | 5/2000 | Parisi et al. | |
| 6,067,669 | A | 5/2000 | Peterson et al. | |
| 6,108,828 | A | 8/2000 | Cheng | |
| 6,145,136 | A | 11/2000 | Parisi et al. | |
| 6,263,518 | B1 | 7/2001 | Magtanong | |
| D450,106 | S | 11/2001 | Herr | |
| D454,941 | S | 3/2002 | Dietzel | |
| 6,418,568 | B1 | 7/2002 | Briggs et al. | |
| 6,845,528 | B2 | 1/2005 | Bantz | |
| 7,013,500 | B1 | 3/2006 | Lin | |
| 7,442,296 | B2 | 10/2008 | Chong et al. | |
| 7,625,488 | B2 | 12/2009 | Blackburn | |
| 7,704,386 | B2 | 4/2010 | Ventura | |
| D644,072 | S | 8/2011 | McDonald et al. | |
| 8,011,030 | B2 | 9/2011 | Li | |
| 8,214,942 | B2 | 7/2012 | Yang et al. | |
| D691,418 | S | 10/2013 | Minton et al. | |
| 8,590,065 | B2 * | 11/2013 | Ali | A47K 1/14 4/287 |
| 8,813,272 | B2 | 8/2014 | Ball | |
| 9,371,636 | B2 * | 6/2016 | Ali | A47K 1/14 |
| 9,499,962 | B2 | 11/2016 | Joseph | |
| D792,562 | S | 7/2017 | Ali | |
| D814,611 | S | 4/2018 | Karnegie | |
| 9,945,106 | B2 * | 4/2018 | Ali | A47K 1/14 |
| 2004/0255378 | A1 | 12/2004 | Tracy | |
| 2008/0244825 | A1 | 10/2008 | Delmonico | |
| 2008/0282466 | A1 | 11/2008 | Swan | |
| 2009/0172870 | A1 | 7/2009 | Hong | |
| 2010/0000011 | A1 | 1/2010 | Angarita | |
| 2010/0138985 | A1 | 6/2010 | Duncan | |
| 2010/0205734 | A1 | 8/2010 | Peterson | |
| 2011/0000014 | A1 | 1/2011 | Ball et al. | |
| 2011/0126347 | A1 | 6/2011 | Qian et al. | |
| 2011/0185494 | A1 | 8/2011 | Beck et al. | |
| 2013/0185855 | A1 | 7/2013 | Ali et al. | |
| 2014/0007334 | A1 | 1/2014 | Golibart | |
| 2014/0115777 | A1 | 5/2014 | Schulze | |
| 2014/0173819 | A1 | 6/2014 | Ali et al. | |
| 2016/0251839 | A1 | 9/2016 | Ali | |
| 2017/0030060 | A1 | 2/2017 | Ali et al. | |

FOREIGN PATENT DOCUMENTS

| | | | |
|---|---|---|---|
| KR | 20-0403195 | Y1 | 12/2005 |
| KR | 10-2010-0065614 | A | 6/2010 |
| WO | 2013/112385 | A1 | 8/2013 |

* cited by examiner

DRAIN STRAINER

BACKGROUND

Technical Field

The present disclosure relates to a stopper assembly for a drain system of a fluid basin, and in particular, a stopper assembly with a replaceable strainer element.

Description of the Related Art

Conventional bathroom sinks typically include a stopper that serves to selectively seal or open a drain in a sink basin. The stopper is mounted to the top of a plunger seated in a drain pipe that extends below the sink basin. The stopper can be moved between open and closed positions by actuating a lever located near the sink faucet. The lever is typically mechanically linked to a horizontal rod that extends below the sink and transmits motion imparted on the lever to the plunger. The horizontal rod typically extends through a pivot seat in the drain pipe to achieve the desired lifting and lowering motion of the plunger. By actuating the lever, a user is able to raise and lower the stopper, and thereby select whether to open or close the sink drain. A conventional stopper and plunger arrangement is shown in FIG. 1.

The conventional drain and stopper mechanisms described above, however, can be problematic. For example, the horizontal rod tends to become misaligned relative to the plunger or the lever after a relatively short period of use, resulting in the stopper sagging or tilting in the open position or failing to close properly. In addition, hair and foreign objects that pass through the drain can clog up the sink, making it necessary to either disassemble the pipes located beneath the sink in order to unclog the drain, or to call a plumber. There is also a risk that valuable items, such as rings and contact lenses, can fall into the sink drain and potentially be lost. It is known to include a strainer beneath a stopper in a bathroom sink. However, conventional strainer assemblies for bathroom sinks can be difficult to access for cleaning and replacement.

BRIEF SUMMARY

Embodiments described herein provide systems and methods that enable a strainer element to be installed in a drain of a fluid basin and selectively replaced as desired in a particularly efficient, robust and sanitary manner. Systems include, for example, a stopper assembly with a removable strainer cartridge having a replaceable strainer element. In some instances, the replaceable strainer element can be released from the strainer cartridge without contacting the strainer element, which may be full of collected debris.

According to one embodiment, a stopper assembly for a drain system of a fluid basin may be summarized as including a stopper head having a seal to sealingly engage the drain system of the fluid basin when the stopper assembly is moved from a drain position to a plug position; a strainer coupled to the stopper head to strain at least a portion of a flow of fluid passing through the drain system of the fluid basin when the stopper assembly is installed and the stopper head is in the drain position, the strainer detachably coupled to the stopper head to facilitate replacement of the strainer with a replacement strainer; and a stopper body operably coupleable to a control element and detachably coupled to the stopper head and the strainer to enable selective removal of the stopper head and the strainer from the stopper body when the stopper body is installed for use and coupled to the control element. The stopper head and the strainer may form a strainer cartridge that is detachable from the stopper body. The stopper head may be detachable from the stopper body by rotating the stopper head about a central axis to a release angle that is between about 45 degrees and about 360 degrees. The stopper head may include at least one actuatable element to selectively release the strainer from the stopper head. The actuatable element of the stopper head may comprise, for example, a pair of latches biased away from each other, the pair of latches configured to engage the strainer when in an expanded position and to release the strainer from the stopper head when the pair of latches are moved from the expanded position to a compressed position.

The stopper head may further include a stopper body engagement feature to detachably couple the stopper head to the stopper body, the engagement feature configured to enable selective detachment of the stopper head from the stopper body while the stopper body remains installed in the drain system. The stopper body may include a supplemental strainer device, the supplemental strainer device located downstream of the strainer when the stopper assembly is assembled and installed for use. The stopper body may include a slender, elongated shaft extending along a central axis of the stopper assembly to receive the strainer. The stopper body may include at least two separable parts, a first one of the separable parts coupleable to the control element of the drain system and a second one of the separable parts including the supplemental strainer device.

According to one embodiment, a stopper assembly for a drain system of a fluid basin may be summarized as including a stopper head having a seal to sealingly engage the drain system of the fluid basin when the stopper assembly is moved from a drain position to a plug position and a strainer to strain at least a portion of a flow of fluid passing through the drain system of the fluid basin when the stopper assembly is installed and the stopper head is in the drain position. The strainer may be fixedly attached or permanently attached to the stopper head or integrally formed with the stopper head. The stopper assembly may further include a stopper body operably coupleable to a control element and detachably coupled to the stopper head and the strainer to enable selective removal of the stopper head and the strainer from the stopper body when the stopper body is installed for use and coupled to the control element.

According to one embodiment, a strainer cartridge for a drain system may be summarized as including a stopper head having a seal device to sealingly engage the drain system when the strainer cartridge is moved from a drain position to a plug position; and a strainer to strain at least a portion of a flow of fluid passing through the drain system when the strainer cartridge is installed and the stopper head is in the drain position, the strainer detachably coupled to the stopper head to facilitate replacement of the strainer with a replacement strainer. The stopper head may include at least one actuatable element to selectively release the strainer from the stopper head. In some instances, the stopper head may include at least one actuatable element to enable a user to selectively release the strainer from the stopper head without physically touching the strainer. The strainer may include a body defining a generally cylindrical receptacle having a plurality of apertures arranged to form a strainer structure. The strainer may be releasable from the stopper head by manipulating a portion of the stopper head.

According to one embodiment, a replaceable strainer of a strainer cartridge for a drain system may be summarized as including: a body portion defining a receptacle, the receptacle including a base and a sidewall extending from a periphery of the base, each of the base and the sidewall including a plurality of apertures to form a strainer structure to strain a flow of fluid passing through the receptacle during operation of the drain system; and a coupler portion having a stopper head engagement feature to detachably couple the replaceable strainer to a stopper head to form the strainer cartridge. The receptacle may taper in a downstream direction such that, when the replaceable strainer is in position for use within the drain system and a lower portion of the replaceable strainer is blocked with collected debris, a portion of the flow of fluid can bypass the collected debris via the sidewall and a gap between the replaceable strainer and the drain system. An upstream end of the replaceable strainer may include a plurality of flexible fingers that splay outward from a central axis of the replaceable strainer. The coupler portion of the strainer may comprise an elongated member having an upstream end and a downstream end, the upstream end including the stopper head engagement feature to detachably couple the replaceable strainer to the stopper head to form the strainer cartridge, and the elongated member including a stopper body passage to insertably receive a portion of a stopper body that is detachably coupleable to the strainer cartridge. The body portion and the coupler portion may be formed as a unitary piece.

According to another embodiment, a method of using a stopper assembly to remove debris from a drain system of a fluid basin may be summarized as including: detaching a strainer cartridge having a stopper head and a strainer holding the debris from a stopper body installed within the drain system of the fluid basin; actuating a release mechanism on the stopper head of the strainer cartridge to release the strainer and the debris from the stopper head; attaching a replacement strainer to the stopper head to form a replacement strainer cartridge; and attaching the replacement strainer cartridge to the stopper body installed within the drain system of the fluid basin. Actuating the release mechanism on the stopper head of the strainer cartridge to release the strainer and the debris from the stopper head may include actuating the release mechanism on the stopper head without physically touching the strainer. Detaching the strainer cartridge from the stopper body installed within the drain system of the fluid basin may include rotating the stopper head of the strainer cartridge about a central axis to a release angle that is between about 45 degrees and about 360 degrees. The method may further include removing a separable part of the stopper body, which includes a supplemental strainer, from the drain system while a base part of the stopper body remains installed within the drain system of the fluid basin. The method may also include moving the replacement strainer cartridge from a drain position to a plug position via the stopper body such that the stopper head sealingly engages the drain system to plug the drain system.

According to yet another embodiment, a method for reducing clogging of a drain system of a fluid basin may be summarized as including installing a strainer cartridge, comprising a stopper head and a strainer coupled to the stopper head, into the drain system of the fluid basin; operating the drain system with the strainer cartridge in position; removing the strainer cartridge from the drain system after the strainer has captured the debris; operating a release mechanism of the strainer cartridge to release the strainer and debris from the stopper head; attaching a replacement strainer to the stopper head to form a replacement strainer cartridge; and installing the replacement strainer cartridge into the drain system of the fluid basin.

According to still yet another embodiment, a stopper assembly for a drain system of a fluid basin may be summarized as including a stopper head having a seal to sealingly engage the drain system of the fluid basin when the stopper assembly is moved from a drain position to a plug position; a stopper body operably coupleable to the control element and detachably coupleable to the stopper head to enable selective removal of the stopper head from the stopper body when the stopper body is installed for use and coupled to the control element; and a strainer to strain at least a portion of a flow of fluid passing through the drain system of the fluid basin when the stopper assembly is installed and the stopper head is in the drain position, the strainer provided between the stopper head and a lower portion of the stopper body. The stopper head may include a stopper body engagement feature to detachably couple the stopper head to the stopper body, the engagement feature configured to enable selective detachment of the stopper head from the stopper body while the stopper body remains installed in the drain system. The stopper body engagement feature of the stopper head may include, for example, threads to engage corresponding threads of the stopper body. The stopper body may include an elongated shaft extending along a central axis of the stopper assembly and the corresponding threads of the stopper body may be provided at an upper end of the elongated shaft. The stopper body may further include a supplemental strainer device, the supplemental strainer device being located downstream of the strainer when the stopper assembly is assembled and installed for use. The strainer may be configured to rest on the supplemental strainer device when the stopper assembly is installed for use. The stopper body may include at least two separable parts, a first one of the separable parts coupleable to the control element of the drain system and a second one of the separable parts including the supplemental strainer device. The stopper body may include a slender, elongated shaft extending along a central axis of the stopper assembly. The strainer may include a stem having a central cavity sized to insertably receive the slender, elongated shaft of the stopper body.

According to another embodiment, a stopper body of a stopper assembly for a drain system of a fluid basin may be summarized as including a lower portion operably coupleable to the control element and an upper portion detachably coupleable to a stopper head of the stopper assembly to enable selective removal of the stopper head from the stopper body when the stopper body is installed for use and coupled to the control element, and wherein the upper portion includes an elongated shaft that extends along a central axis to receive a strainer of the stopper assembly. The elongated shaft may be generally cylindrical and may include threads or other coupling features at an upper end thereof for mating with corresponding threads of other coupling features of the stopper head.

According to another embodiment, a method of using a stopper assembly to remove debris from a drain system of a fluid basin may be summarized as including detaching a stopper head from a stopper body installed within the drain system of the fluid basin; removing a strainer holding the debris from the drain system of the fluid basin; positioning a replacement strainer such that an elongated shaft of the stopper body is received within a cavity of the replacement strainer; and attaching the stopper head to the stopper body installed within the drain system of the fluid basin with the replacement strainer positioned between the stopper head and a lower portion of the stopper body.

DETAILED DESCRIPTION

In the following description, certain specific details are set forth in order to provide a thorough understanding of various disclosed embodiments. However, one of ordinary skill in the relevant art will recognize that embodiments may be practiced without one or more of these specific details. In other instances, well-known features or structures associated with fluid basins, drain systems, drain stoppers and strainers may not be shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 1:
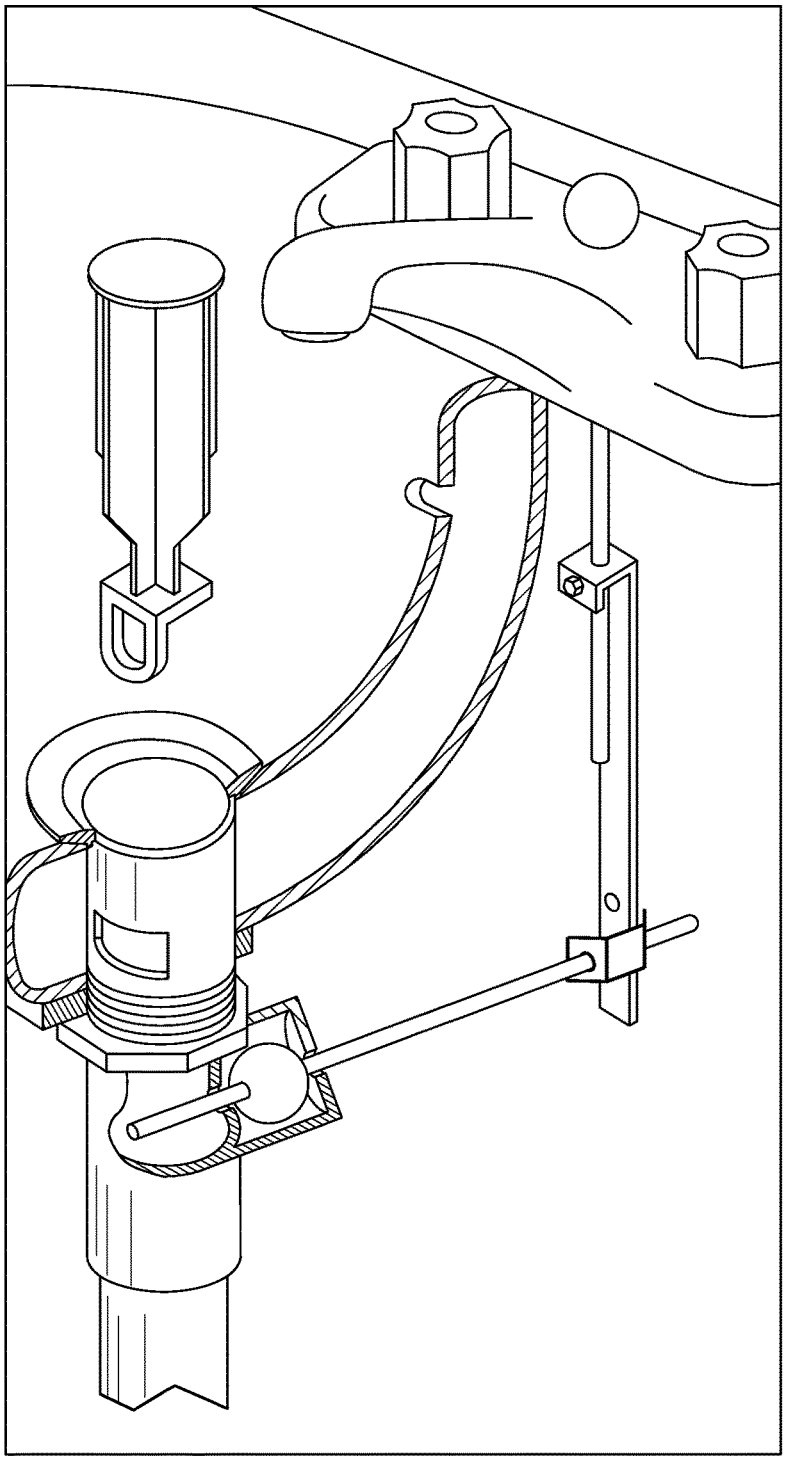
FIG. 1 (Prior Art)
FIG. 1 is a perspective, partial cross-sectional view of a sink basin including a conventional stopper arrangement.
Figure 2:
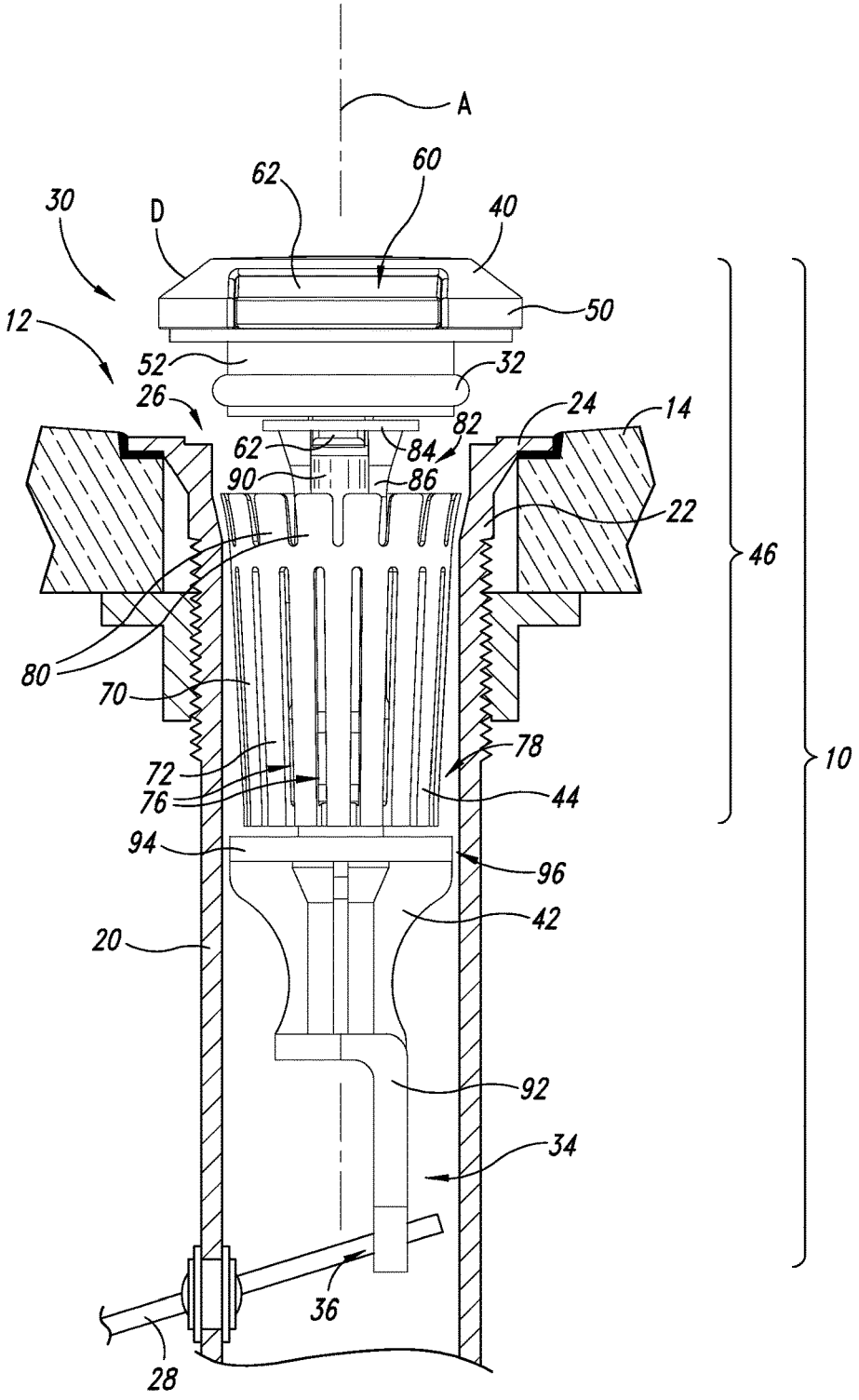
FIG. 2 is a side elevational view of a stopper assembly, according to an example embodiment, shown installed in a sink basin with the stopper assembly in an unplugged or drain position.
Figure 3:
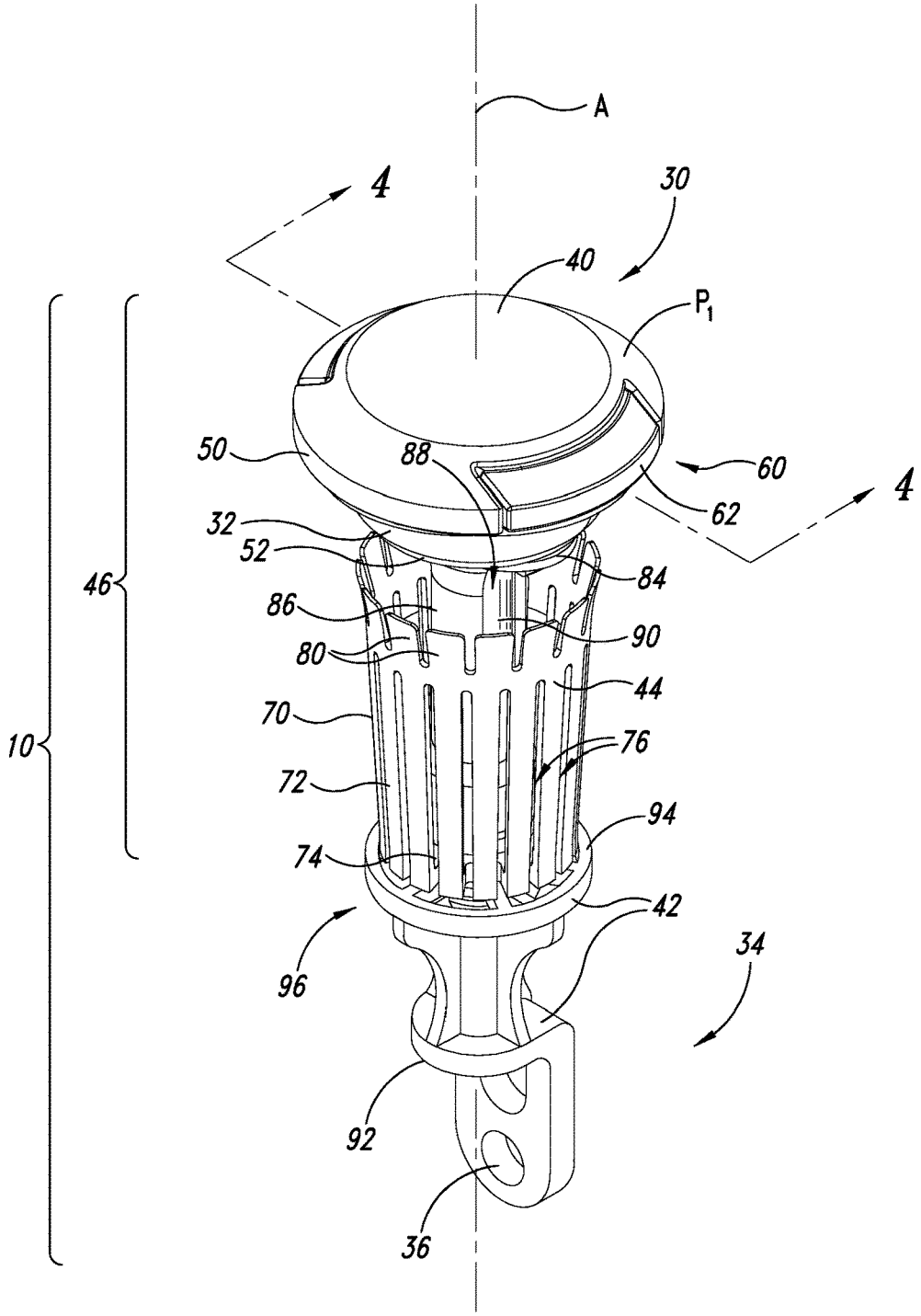
FIG. 3 is an isometric view of the stopper assembly of FIG. 2 shown in an engaged configuration.
Figure 4:
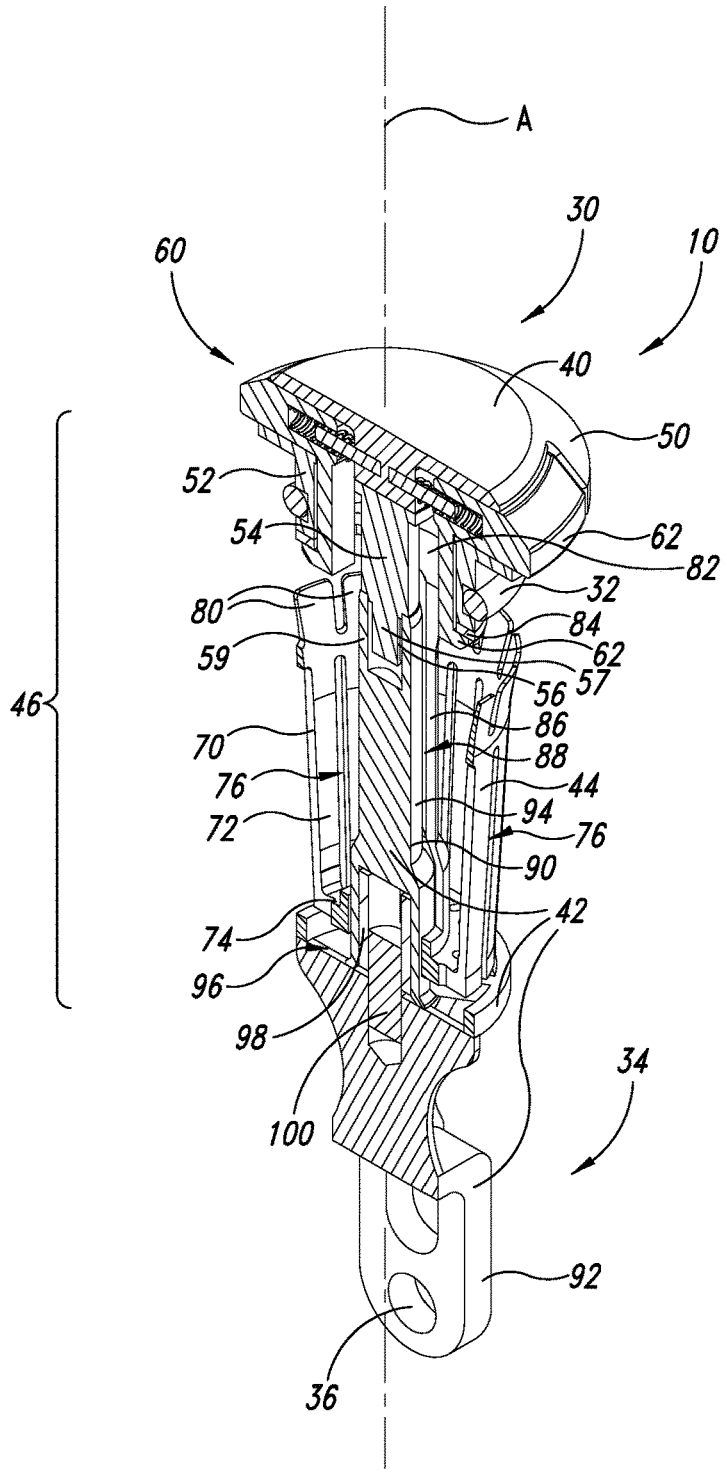
FIG. 4 is a cross-sectional isometric view of the stopper assembly of FIG. 2 taken along line 4-4 in FIG. 3.

FIGS. 2 through 8 show a stopper assembly 10 for a drain system 12 of a fluid basin 14 according to one example embodiment. In particular, FIG. 2 shows the stopper assembly 10 installed in the drain system 12, FIGS. 3 and 4 show additional details of the stopper assembly 10 apart from the drain system 12, and FIGS. 5 through 8 illustrate methods of using the stopper assembly 10.

With reference initially to FIG. 2, the stopper assembly 10 is shown installed in a fluid basin 14 (e.g., a sink basin) with the stopper assembly 10 in an unplugged or drain position D. In this position, fluid (e.g., water) may drain out of the fluid basin 14 via the drain system 12. The drain system 12 includes a drain pipe 20 that extends below the fluid basin 14 and includes an upper portion 22 having a sink flange 24 that is received within a drain opening 26 of the basin 14. The upper end of the drain system 12 may be shaped to closely receive an upper end 30 of the stopper assembly 10 when the stopper assembly 10 is moved downward from the drain position D shown in FIG. 2 to a plug position (not shown). The upper end 30 of the stopper assembly 10 may include a seal device 32, such as, for example, a gasket or an o-ring to sealingly engage the drain system 12 when the stopper assembly 10 is moved into the plug position to prevent fluid (e.g., water) from draining out of the basin 14. In other instances, a seal device 32, such as a bead or lip, may be formed integrally with the upper end 30 of the stopper assembly 10. The stopper assembly 10 may be conveniently moved between the drain position D and the plug position by a control rod 28 which transmits motion imparted by a user on a lever (not shown) located remotely from the drain system 12 to a lower end 34 of the stopper assembly 10. For this purpose, the lower end 34 of the stopper assembly 10 may include a control aperture 36 or other feature for coupling to the control rod 28.

With reference now to FIGS. 3 and 4, the stopper assembly 10 comprises a stopper head 40 and a stopper body 42. The stopper head 40 is provided at the upper end 30 of the stopper assembly 10 and is selectively attachable to the stopper body 42, a portion of which forms the lower end 34 of the stopper assembly 10. The stopper assembly 10 further comprises a strainer 44 provided between the stopper head 40 and the stopper body 42 to trap debris or other matter as fluid passes through the strainer 44 during use. In some embodiments, the strainer 44 may be detachably coupled to the stopper head 40, as discussed in further detail below. In other embodiments, the strainer 44 may be fixedly attached or permanently attached to the stopper head 40 or integrally formed therewith. Advantageously, when the strainer 44 is detachably coupled to the stopper head 40, the strainer 44 may be removed with the stopper head 40 and selectively replaced with a replacement strainer 44 in a particularly convenient manner. In other instances, the strainer 44 may be removed with the stopper head 40 and cleaned for reuse in the drain system 12. In still other embodiments, the strainer 44 may be held or otherwise provided between the stopper body 42 and the stopper head 40 without attaching to either component. In this case, the strainer 44 may be withdrawn from the drain system 12 separately of the stopper head 40.

The stopper head 40 may have a generally circular profile similar to conventional stoppers or may have other shapes. As shown in FIGS. 3 and 4, the stopper head 40 may have a general mushroom shape with an enlarged head portion 50 and a reduced neck portion 52. The seal device 32 described above may be positioned around the reduced neck portion 52. The stopper head 40 may further include an elongated stem portion 54 (FIG. 4) extending along a central axis A of the stopper assembly 10 for selectively engaging the stopper body 42. In some instances, for example, the stopper head 40 may include a stem portion 54 with an engagement feature 56 (FIG. 4), such as a notch, keyway or key element, for engaging a corresponding feature 58 (FIG. 8) on the stopper body 42 as the stopper head 40 is rotated relative to the stopper body 42 about the central axis A. For example, rotating the stopper head 40 about ninety degrees or more may transition the stopper head 40 from an engaged position $P_1$ (FIG. 3), in which the stopper head 40 is securely attached to the stopper body 42, to a disengaged position $P_2$ (FIG. 5), in which the stopper head 40 is detached or freely separable from the stopper body 42. In other embodiments, the stopper head 40 and stopper body 42 may include other features for facilitating selective engagement and disengagement of the same, such as, for example, a detent mechanism, clips, snaps or other fasteners. Irrespective of the particular fastening device, the stopper head 40 and the stopper body 42 are configured to enable separation of the stopper head 40 from the stopper body 42 while the stopper body 42 remains installed in the drain system 12 by twisting, pulling, manipulating or otherwise interacting with the stopper head 40 from within the interior of the fluid basin 14. Advantageously, the stopper head 40 can therefore be removed from the drain system 12 without removing or disengaging the control rod 28 from the stopper body 42.

The stopper head 40 may further include coupling devices for selectively engaging the strainer 44. For instance, the example embodiment includes a release mechanism 60 that may be actuated to release a pair of spring-biased latch members 62 from engagement with a stopper head engagement feature 84 of the strainer 44. In this manner, the strainer 44 may be released, separated or detached from the stopper head 40 by actuating the release mechanism 60 toward the central axis A. In other embodiments, the stopper head 40 and the strainer 44 may include other features for facilitating selective engagement and disengagement of the same, such as, for example, a detent mechanism, clips, snaps or other fasteners. Other example release mechanisms are shown and described in U.S. Provisional Patent Application No. 61/680,204 filed Aug. 6, 2012, which application is incorporated herein by reference in its entirety.

Irrespective of the particular release mechanism 60, the stopper head 40 and the strainer 44 are configured to enable separation of the stopper head 40 from the strainer 44 after the stopper head 40 and strainer 44 are removed as a cartridge 46 from the drain system 12. In some embodiments, such as, for example, the example embodiment shown in FIGS. 2 through 8, the strainer 44 is selectively detachable from the stopper head 40 without requiring a user to touch or otherwise contact the strainer 44. This may be particularly advantageous when replacing a strainer 44 that is soiled with debris, such as, for example, hair and other matter that collects in the strainer 44 during use.

In some embodiments, the strainer 44 may include a body portion defining a receptacle 70. The receptacle 70 may include a sidewall 72 extending from a periphery of a base 74. Each of the sidewall 72 and the base 74 may include a plurality of apertures 76 to form a strainer structure to strain fluid passing through the receptacle 70 during operation of the drain system 12. The receptacle 70 may be generally cylindrical and may encircle a portion of the strainer body 42. In some embodiments, the strainer 44 may taper in a downstream direction such that, when the strainer 44 is in position for use within the drain system 12 (as shown in FIG. 2) and a lower portion of the strainer 44 is blocked with collected debris, fluid can bypass the debris in the strainer 44 via the apertures in the sidewall 72 and a gap 78 between the strainer 44 and the drain pipe 20 of the drain system 12.

An upstream end of the strainer 44 may include a plurality of flexible fingers 80 that splay outward from the central axis A of the strainer 44. The fingers 80 may flex in response to contact with the drain pipe 20 as the stopper assembly 10 is drawn into the plug position. In the drain position D, shown in FIG. 2, the fingers 80 may extend near or in close proximity to the drain pipe 20 or may contact the drain pipe 20. In this manner, most of the fluid and any matter passing into the drain system 12 inevitably passes through the receptacle 70 of the strainer 44.

The strainer 44 may include a coupler portion 82 having a stopper head engagement feature 84 to detachably couple the strainer 44 to the stopper head 40 to form the strainer cartridge 46. The stopper head engagement feature 84 may include, for example, an aperture 85 or apertures to receive a lower end of the spring-biased latch members 62 of the stopper head 40. In other embodiments, the engagement feature may include a detent mechanism, clips, snaps or other fastener devices. The coupler portion 82 may include a central stem or elongated member 86 that extends in the direction of the central axis A to an upper end of the strainer 44. The stem or elongated member 86 may partially or completely surround a shaft 90 of the stopper body 42 when the strainer cartridge 46 is attached to the stopper body 42. In this manner, the stem or elongated member 86 may have a central cavity or passage 88 through which the shaft 90 of the stopper body 42 may be insertably received during use. The shaft 90 of the stopper body 42 may be slender and extend along the central axis A of the stopper assembly 10 to receive the strainer 44 thereabout. The shaft 90 may be cylindrical or predominately cylindrical and lack wings, gussets or other structures typical of conventional drain stoppers.

As can be appreciated from FIG. 4, the stopper body 42 may include one or more separable components. For example, the stopper body 42 may include a base part 92 and a separable part 94 that includes a supplemental strainer 96 and the shaft 90. The supplemental strainer 96 may be in the form of an annular structure with spokes or other strainer structure arrangement. The separable part 94 may be provided with threads or a threaded insert 98, for example, for mating with a correspondingly threaded feature, such as, for example, a threaded stud 100 provided on the base part 92. In this manner, the separable part 94, including the supplemental strainer 96, may be unthreaded from the base part 92 while the base part 92 remains coupled to the control rod 28, if desired, for cleaning or replacement purposes. Although the example embodiment of FIGS. 2 through 8 shows two components of the stopper body 42 coupled together via a threaded insert 98 and a threaded stud 100, it is appreciated that in other embodiments, components of the stopper body 42 may be joined with other coupling devices, such as, for example, a detent mechanism, clips, snaps or other fasteners. In yet other embodiments, the stopper body 42 may be formed as a single, unitary body.

With reference to FIGS. 5 through 8, a method of using the stopper assembly 10 to remove debris from the drain system 12 (FIG. 2) of the fluid basin 14 (FIG. 2) will now be described. The method may begin with installing the stopper assembly 10 in the drain system 12 and coupling the stopper body 42 to the control rod 28 so that the stopper body 42 may be selectively moved between the unplugged or drain position D and the plug position. Coupling the stopper body 42 to the control rod 28 may include, for example, passing the control rod 28 through the control aperture 36 or other coupling feature of the stopper body 42.

Fluid and debris may then be intermittently passed through the drain system 12 as the fluid basin 14 is used on a daily or periodic basis. As the fluid and debris flows through the drain system 12, a substantial portion passes through the strainer 44 of the stopper assembly 10 and at least some or a significant portion of the debris will become trapped in the strainer 44. Debris may therefore accumulate in the strainer 44 over time. The strainer 44 may then be removed and cleaned or replaced as desired to clear the drain system 12 of the collected debris.

Figure 5:
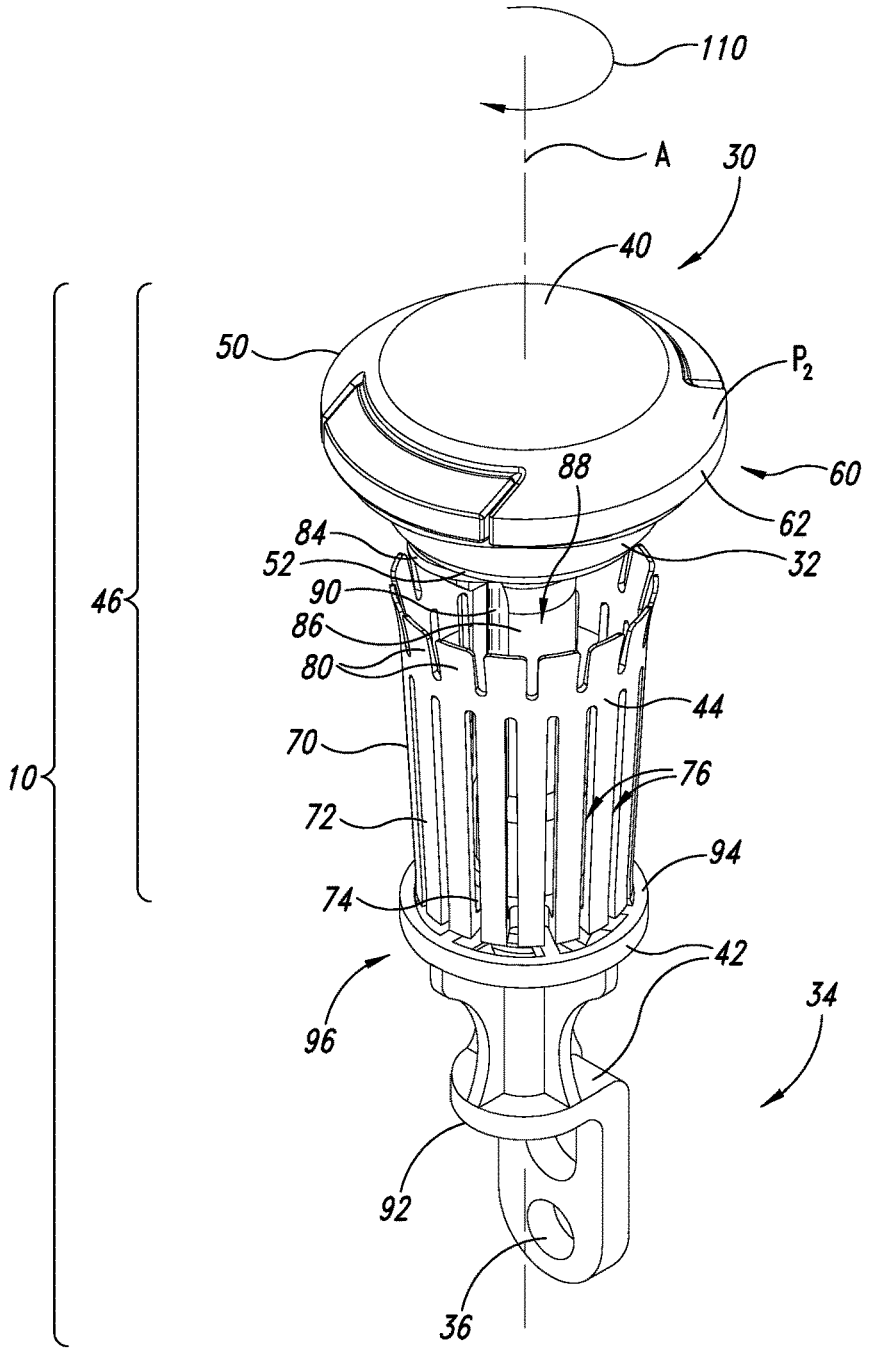
FIG. 5 is an isometric view of the stopper assembly of FIG. 2 shown in a disengaged configuration.

In particular, and with reference to FIG. 5, the strainer cartridge 46, which comprises the stopper head 40 and the strainer 44 holding the debris, may be detached from the stopper body 42, which remains installed within the drain system 12 of the fluid basin 14. Detaching the strainer cartridge 46 may include, for example, rotating the strainer cartridge 46 about the central axis A, as represented by the arrow labeled 110, such that corresponding engagement features 56, 58 provided between the strainer cartridge 46 and the stopper body 42 disengage. For instance, the strainer cartridge 46 may be rotated about ninety degrees or more relative to the stopper body 42 such that a keyed engagement between a lower end 57 of the stopper head 40 and an upper end 59 of the shaft 90 disengages. In other instances, the strainer cartridge 46 and the stopper body 42 may be provided with a detent mechanism, a clip, a snap or other fastener device, such that the strainer cartridge 46 may be released after overcoming a threshold force, such as by pulling the strainer cartridge 46 upwardly with sufficient force to overcome the threshold force provided by the detent mechanism, clip, snap or other fastener device.

Figure 6:
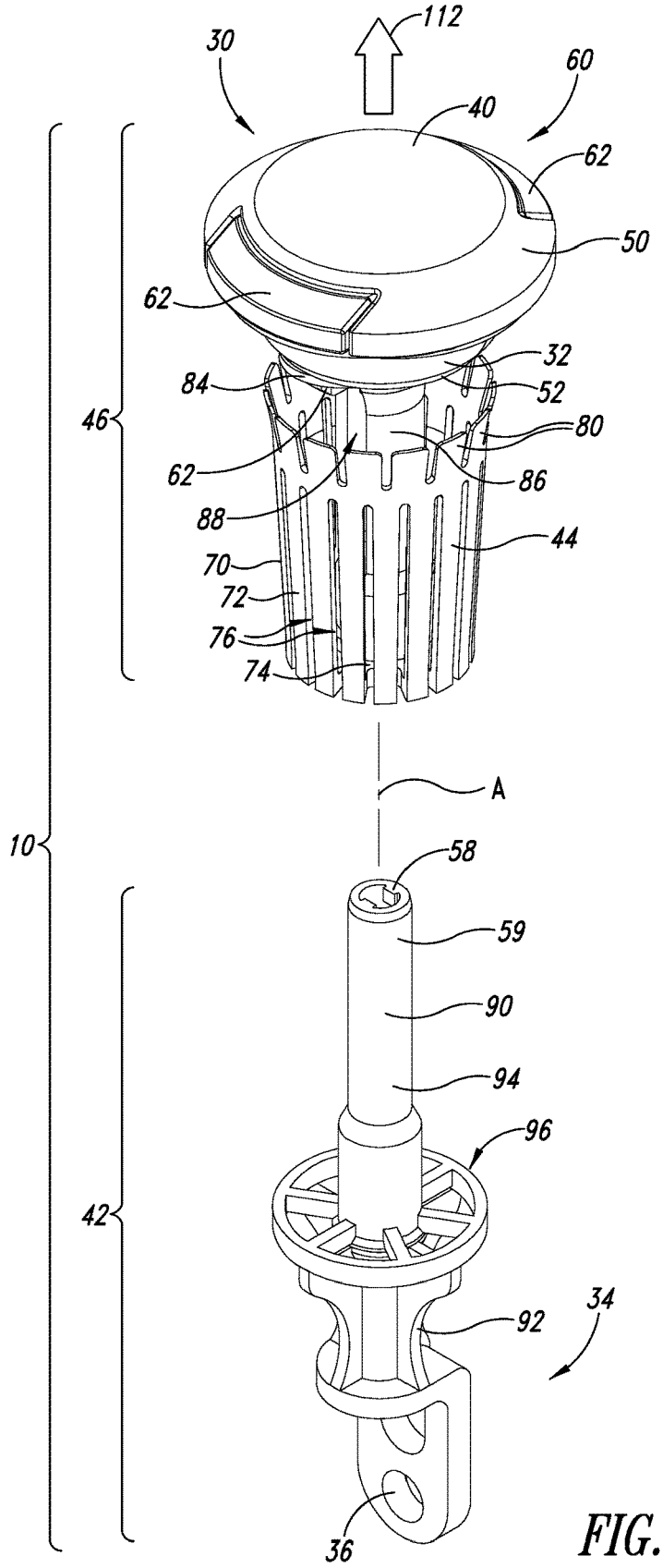
FIG. 6 is an isometric view of the stopper assembly of FIG. 2 shown with a strainer cartridge thereof separated from a stopper body thereof.

With reference to FIG. 6, after detaching the strainer cartridge 46, the strainer cartridge 46 may be removed from the drain system 12 and separated from the stopper body 42 in the direction indicated by the arrow labeled 112, while the stopper body 42 remains conveniently installed in the drain system 12. In this manner, the strainer cartridge 46 can be quickly removed from the drain system 12 with minimal effort and without disassembling the drain system 12.

Figure 7:
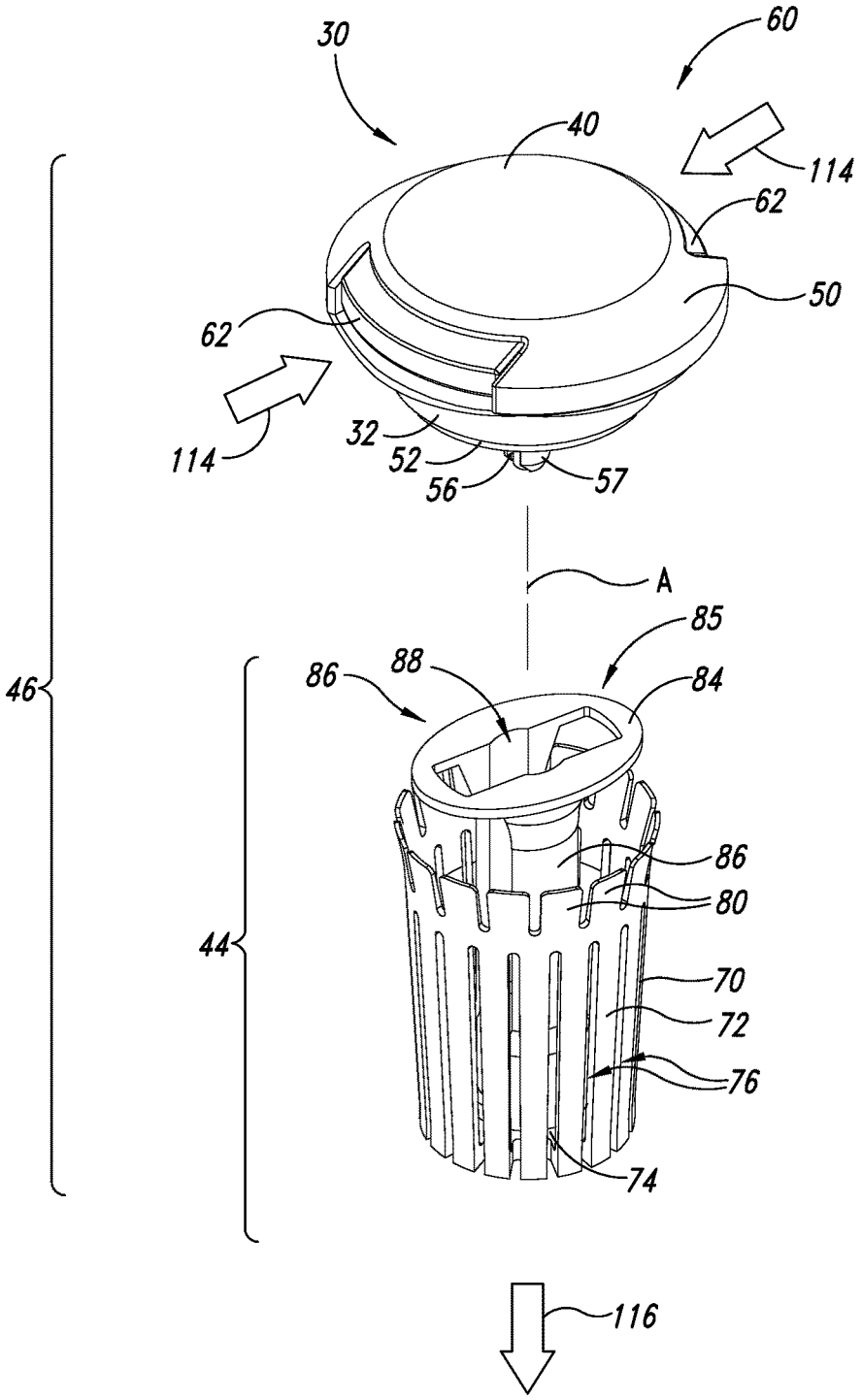
FIG. 7 is an isometric view of the strainer cartridge of the stopper assembly of FIG. 2 shown with a stopper head thereof separated from a strainer thereof.
Figure 8:
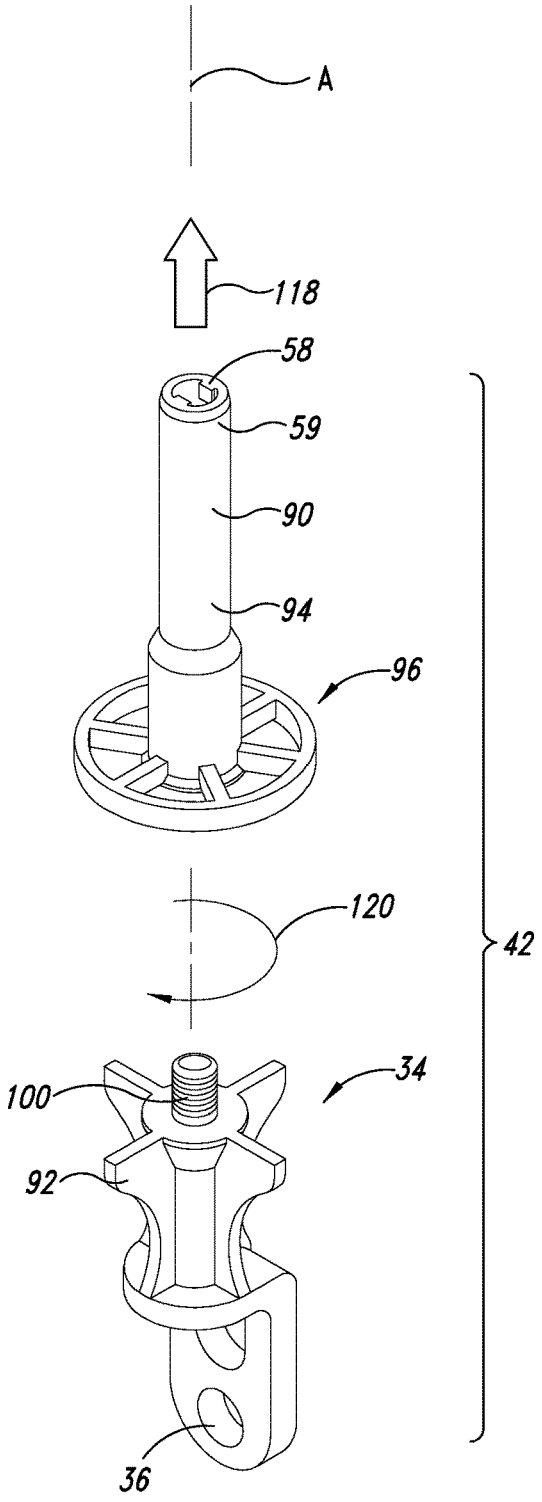
FIG. 8 is an isometric view of the stopper body of the stopper assembly of FIG. 2 shown with a supplemental strainer part thereof separated from a base part thereof.

With reference to FIG. 7, after removing the strainer cartridge 46 from the drain system 12, the strainer 44 and the debris collected therein can be released from the stopper head 40 by actuating a release mechanism 60 on the stopper head 40 of the strainer cartridge 46. Actuating the release mechanism may include, for example, actuating a pair of opposing spring-biased latch members 62 to release the strainer 44, as indicated by the arrows labeled 114. Once released, the strainer 44 may fall under the influence of gravity into a waste or compost receptacle, as represented by the arrow labeled 116. Next, a replacement strainer 44 may be attached to the stopper head 40 to form a replacement strainer cartridge 46 and the replacement strainer cartridge 46 may be attached to the stopper body 42 in the drain system 12. Alternatively, the debris collected in the strainer 44 may be emptied into a waste or compost receptacle and the strainer 44 reattached to the stopper head 40 for reuse.

Still further, in some instances, the stopper head 40 may be reattached to the stopper body 42 in the drain system 12 without a strainer 44 present. Without the strainer 44, however, the stopper assembly 10 may nevertheless provide some straining functionality. For example, the supplemental strainer 96 of the stopper body 42 may collect debris as fluid passes through the stopper assembly 10 during operation of the fluid basin 14. As discussed above, the supplemental strainer 96 may be provided on a separable part 94 that is selectively detachable from a base part 92 coupled to the control rod 28. Accordingly, with reference to FIG. 8, the method of using the stopper assembly 10 to remove debris from the drain system 12 may further include removing the separable part 94 of the stopper body 42, which includes the supplemental strainer 96, from the drain system 12 while the base part 92 of the stopper body 42 remains installed within the drain system 12, as represented by the arrow labeled 118. Removing the separable part 94 of the stopper body 42, which includes the supplemental strainer 96, from the drain system 12, may include unthreading the separable part 94 from the base part 92, as represented by the arrow labeled 120.

Other methods of removing debris or otherwise reducing clogging of a drain system of a fluid basin may be provided in view of the stopper assemblies 10, components and systems described herein. For example, a method of reducing clogging may include installing a strainer cartridge 46, comprising a stopper head 40 and a strainer 44 coupled to the stopper head 40, into the drain system 12 of the fluid basin 14; operating the drain system 12 with the strainer cartridge 46 in position; removing the strainer cartridge 46 from the drain system 12 after the strainer 44 has captured debris; operating a release mechanism 60 of the strainer cartridge 46 to release the strainer 44 and debris from the stopper head 40; attaching a replacement strainer 44 to the stopper head 40 to form a replacement strainer cartridge 46; and installing the replacement strainer cartridge 46 into the drain system 12 of the fluid basin 14.

Figure 9:
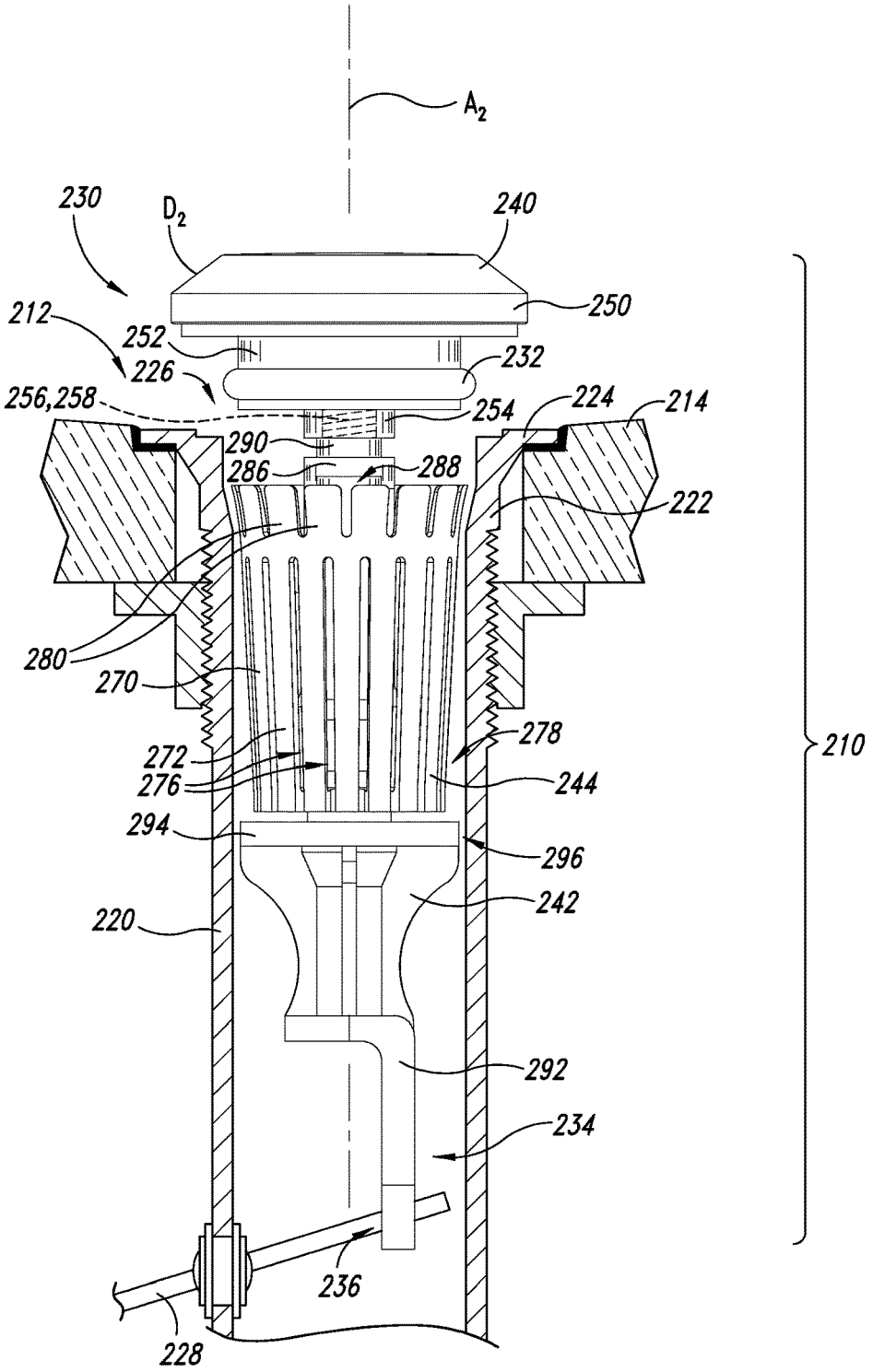
FIG. 9 is a side elevational view of a stopper assembly, according to another example embodiment, shown installed in a sink basin with the stopper assembly in an unplugged or drain position.
Figure 10:
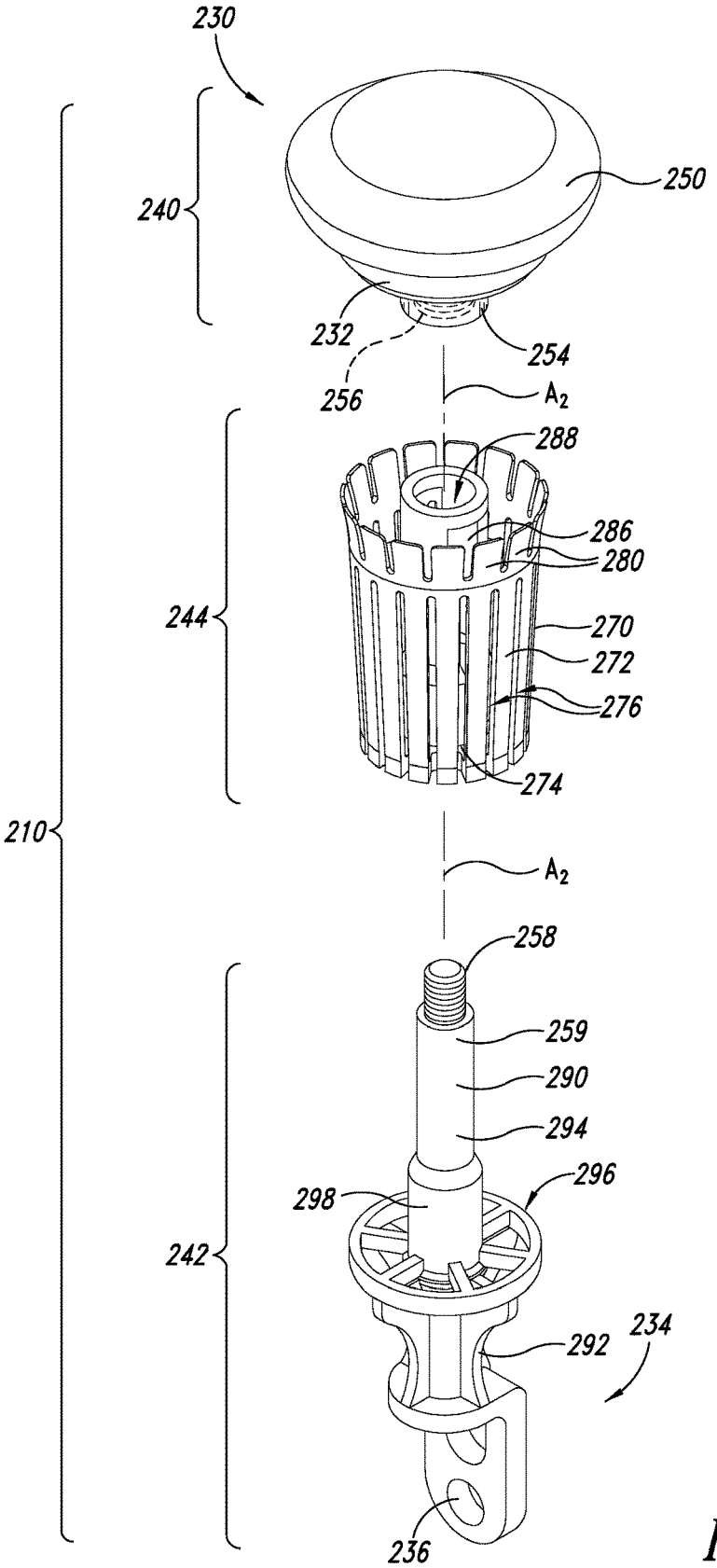
FIG. 10 is an exploded isometric view of the stopper assembly of FIG. 9.

FIGS. 9 and 10 show a stopper assembly 210 for a drain system 212 of a fluid basin 214 according to another example embodiment. FIG. 9 shows the stopper assembly 210 installed in the drain system 212 and FIG. 10 shows an exploded view of the stopper assembly 210.

With reference initially to FIG. 9, the stopper assembly 210 is shown installed in a fluid basin 214 (e.g., a sink basin) with the stopper assembly 210 in an unplugged or drain position $D_2$. In this position, fluid (e.g., water) may drain out of the fluid basin 214 via the drain system 212. The drain system 212 includes a drain pipe 220 that extends below the fluid basin 214 and includes an upper portion 222 having a sink flange 224 that is received within a drain opening 226 of the basin 214. The upper end of the drain system 212 may be shaped to closely receive an upper end 230 of the stopper assembly 210 when the stopper assembly 210 is moved downward from the drain position $D_2$ shown in FIG. 9 to a plug position (not shown). The upper end 230 of the stopper assembly 210 may include a seal device 232, such as, for example, a gasket or an o-ring to sealingly engage the drain system 212 when the stopper assembly 210 is moved into the plug position to prevent fluid (e.g., water) from draining out of the basin 214. In other instances, a seal device 232, such as a bead or lip, may be formed integrally with the upper end 230 of the stopper assembly 210. The stopper assembly 210 may be conveniently moved between the drain position $D_2$ and the plug position by a control rod 228 which transmits motion imparted by a user on a lever (not shown) located remotely from the drain system 212 to a lower end 234 of the stopper assembly 210. For this purpose, the lower end 234 of the stopper assembly 210 may include a control aperture 236 or other feature for coupling to the control rod 228.

With reference now to FIGS. 9 and 10, the stopper assembly 210 comprises a stopper head 240 and a stopper body 242. The stopper head 240 is provided at the upper end 230 of the stopper assembly 210 and is selectively attachable to the stopper body 242, a portion of which forms the lower end 234 of the stopper assembly 210. The stopper assembly 210 further comprises a strainer 244 provided between the stopper head 240 and the stopper body 242 to trap debris or other matter as fluid passes through the strainer 244 during use. In the example embodiment show in FIGS. 9 and 10, the strainer 244 is positioned between the stopper body 242 and the stopper head 240 without directly attaching to either component. Rather, the strainer 244 rests on the stopper body 242 below the stopper head 240. For this purpose, the strainer 244 may include a central stem portion 286 with an internal passage or cavity 288 that is configured to insertably receive an elongated shaft 290 of the stopper body 242. In this case, the strainer 244 may be withdrawn from the drain system 212 separately of the stopper head 240.

The stopper head 240 may have a generally circular profile similar to conventional stoppers or may have other shapes. As shown in FIGS. 9 and 10, the stopper head 240 may have a general mushroom shape with an enlarged head portion 250 and a reduced neck portion 252. The seal device 232 described above may be positioned around the reduced neck portion 252. The stopper head 240 may further include an elongated stem portion 254 extending along a central axis $A_2$ of the stopper assembly 210 for selectively engaging the stopper body 242. In some embodiments, for example, the stopper head 240 may include a stem portion 254 with an engagement feature 256, such as, for example, internal threads, for engaging a corresponding feature 258 on the stopper body 242 as the stopper head 240 is rotated relative to the stopper body 242 about the central axis $A_2$. More particularly, the stopper head 240 may be securely attached to the stopper body 242 by threading the stopper head 240 onto to the stopper body 242 and detached by unthreading the stopper head 240 from the stopper body 242. Although the example embodiment of FIGS. 9 and 10 shows the stopper head 240 as including internal threads to engage corresponding external threads of the stopper body 242, it is appreciated that in other instances, the stopper head 240 may include external threads and the stopper body may include internal threads.

In still other embodiments, the stopper head 240 and stopper body 242 may include other features for facilitating selective engagement and disengagement of the same, such as, for example, a detent mechanism, clips, snaps or other fasteners. Irrespective of the particular fastening device, the stopper head 240 and the stopper body 242 are configured to enable separation of the stopper head 240 from the stopper body 242 while the stopper body 242 remains installed in the drain system 212 by rotating, twisting, pulling, manipulating or otherwise interacting with the stopper head 240 from within the interior of the fluid basin 214. Advantageously, the stopper head 240 can therefore be removed from the drain system 212 without removing or disengaging the control rod 228 from the stopper body 242.

In some embodiments, the strainer 244 may include a body portion defining a receptacle 270. The receptacle 270 may include a sidewall 272 extending from a periphery of a base 274. Each of the sidewall 272 and the base 274 may include a plurality of apertures 276 to form a strainer structure to strain fluid passing through the receptacle 270 during operation of the drain system 212. The receptacle 270 may be generally cylindrical and may encircle a portion of the strainer body 242. In some embodiments, the strainer 244 may taper in a downstream direction such that, when the strainer 244 is in position for use within the drain system 212 (as shown in FIG. 9) and a lower portion of the strainer 244 is blocked with collected debris, fluid can bypass the debris in the strainer 244 via the apertures in the sidewall 272 and a gap 278 between the strainer 244 and the drain pipe 220 of the drain system 212.

An upstream end of the strainer 244 may include a plurality of flexible fingers 280 that splay outward from the central axis $A_2$ of the strainer 244. The fingers 280 may flex in response to contact with the drain pipe 220 as the stopper assembly 210 is drawn into the plug position. In the drain position $D_2$, shown in FIG. 9, the fingers 280 may extend near or in close proximity to the drain pipe 220 or may contact the drain pipe 220. In this manner, most of the fluid and any matter passing into the drain system 212 inevitably passes through the receptacle 270 of the strainer 244. In addition, the interaction of the strainer 244 with the surrounding drain pipe 220 may assist in keeping the stopper body 242, and hence stopper assembly 210, centered in the drain pipe 220.

The strainer 244 may further include a central stem or elongated member 286 that extends in the direction of the central axis $A_2$ to an upper end of the strainer 244. The stem or elongated member 286 may partially or completely surround a shaft 290 of the stopper body 242 when the strainer 244 is positioned for use between the stopper head 240 and the stopper body 242. In this manner, the stem or elongated member 286 may have a central cavity or passage 288 through which the shaft 290 of the stopper body 242 may be insertably received during use. The shaft 290 of the stopper body 242 may be slender and extend along the central axis $A_2$ of the stopper assembly 210 to receive the strainer 244 thereabout. The shaft 290 may be cylindrical or predominately cylindrical and lack wings, gussets or other structures typical of conventional drain stoppers.

The stopper body 242 may include one or more separable components. For example, the stopper body 242 may include a base part 292 and a separable part 294 that includes a supplemental strainer 296 and the shaft 290. The supplemental strainer 296 may be in the form of an annular structure with spokes or other strainer structure arrangement. The supplemental strainer 296 may form a shelf on which the strainer 244 may rest. In other instances, the strainer 244 may rest on an enlarged stepped portion 298 or other feature provided on the shaft 290 for this purpose. The separable part 294 may be provided with threads or a threaded insert, for example, for mating with a correspondingly threaded feature, such as, for example, a threaded stud provided on the base part 292. In this manner, the separable part 294, including the supplemental strainer 296, may be unthreaded from the base part 292 while the base part 292 remains coupled to the control rod 228, if desired, for cleaning or replacement purposes. Although the example embodiment of FIG. 9 and shows two components 292, 294 of the stopper body 242 coupled together, it is appreciated that in other embodiments, the stopper body 42 may be formed as a single, unitary body or may include more than two separate components coupled together.

Although the stopper assemblies 10, 210 and components thereof described herein are shown as interfacing with a conventional sink arrangement with a control rod 28, 228 for moving the stopper assemblies 10, 210 between an unplugged or drain position D, $D_2$ and a plug position, it is appreciated that the stopper assemblies 10, 210, components thereof and aspects of the same may be used with a variety of different fluid basins and control elements to provide the various functionalities described herein.

Moreover, the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

This application is a continuation of U.S. patent application Ser. No. 15/162,408, filed May 23, 2016, which is a continuation of U.S. patent application Ser. No. 14/060,477, filed Oct. 22, 2013, now U.S. Pat. No. 9,371,636, which is a continuation of U.S. patent application Ser. No. 13/686,724, filed Nov. 27, 2012, now U.S. Pat. No. 8,590,065, which claims the benefit of US Provisional Application Nos. 61/680,204, filed Aug. 6, 2012 and 61/590,263, filed Jan. 24, 2012. The entire contents of each of the foregoing applications are hereby incorporated by referenced herein.

The invention claimed is:

1. A strainer cartridge for a drain system, the strainer cartridge comprising:

a stopper head; and a strainer detachably coupled to the stopper head to facilitate replacement of the strainer with a replacement strainer, and wherein the stopper head includes at least one actuatable element to selectively release the strainer from the stopper head.

2. The strainer cartridge of claim 1 wherein the at least one actuatable element is configured to enable a user to selectively release the strainer from the stopper head without physically touching the strainer.

3. The strainer cartridge of claim 1 wherein the strainer includes a body defining a generally cylindrical receptacle having a plurality of apertures arranged to form a strainer structure.

4. The strainer cartridge of claim 1 wherein the strainer is releasable from the stopper head by manipulating a portion of the stopper head.

5. The strainer cartridge of claim 1 wherein the at least one actuatable element of the stopper head includes a depressible portion of the stopper head.

6. The strainer cartridge of claim 1 wherein the at least one actuatable element of the stopper head includes spring-biased latches.

7. A method of using a stopper cartridge to remove debris from a drain system, the method comprising:

removing a strainer cartridge having a stopper head and a strainer holding the debris from an installed position within the drain system of the fluid basin;

actuating a release mechanism of the strainer cartridge to release the strainer and the debris from the stopper head; and attaching a replacement strainer to the stopper head to form a replacement strainer cartridge.

8. The method of claim 7 wherein actuating the release mechanism of the strainer cartridge to release the strainer and the debris from the stopper head includes actuating the release mechanism without physically touching the strainer.

9. The method of claim 7 wherein actuating the release mechanism of the strainer cartridge to release the strainer and the debris from the stopper head includes actuating spring-biased latches to release the strainer.

10. The method of claim 7 wherein actuating the release mechanism of the strainer cartridge to release the strainer and the debris from the stopper head includes manipulating a portion of the stopper head.

11. A strainer cartridge for a drain system, the strainer cartridge comprising:

a stopper head; and a strainer detachably coupled to the stopper head, the stopper head including at least one actuatable element to selectively release the strainer from the stopper head.

12. The strainer cartridge of claim 11 wherein the at least one actuatable element is configured to enable a user to selectively release the strainer from the stopper head without physically touching the strainer.

13. The strainer cartridge of claim 11 wherein the strainer includes a body defining a generally cylindrical receptacle having a plurality of apertures arranged to form a strainer structure.

14. The strainer cartridge of claim 13 wherein the receptacle tapers in a downstream direction.

15. The strainer cartridge of claim 11 wherein the strainer includes a plurality of flexible fingers at an upstream end of the strainer that splay outward.

16. The strainer cartridge of claim 11 wherein the strainer includes a coupler having a stopper head engagement feature to detachably couple the strainer to the stopper head to form the strainer cartridge.

17. The strainer cartridge of claim 16 wherein the coupler comprises an elongated member having an upstream end and a downstream end, the upstream end including the stopper head engagement feature to detachably couple the strainer to the stopper head to form the strainer cartridge.

18. The strainer cartridge of claim 11 wherein the strainer is releasable from the stopper head by manipulating a portion of the stopper head.

19. The strainer cartridge of claim 11 wherein the at least one actuatable element of the stopper head includes a depressible portion of the stopper head.

20. The strainer cartridge of claim 11 wherein the at least one actuatable element of the stopper head includes spring-biased latches.

* * * * *